US007596230B2

(12) United States Patent
Petersen

(10) Patent No.: US 7,596,230 B2
(45) Date of Patent: Sep. 29, 2009

(54) METHOD FOR DETECTION OF ULTRASOUND IN A LISTENING DEVICE WITH TWO OR MORE MICROPHONES, AND LISTENING DEVICE WITH TWO OR MORE MICROPHONES

(75) Inventor: Kim Spetzler Petersen, Hellerup (DK)

(73) Assignee: Oticon A/S, Smørum (DK)

( * ) Notice: Subject to any disclaimer, the term of this patent is extended or adjusted under 35 U.S.C. 154(b) by 943 days.

(21) Appl. No.: 10/989,555

(22) Filed: Nov. 17, 2004

(65) Prior Publication Data

US 2006/0104465 A1 May 18, 2006

(51) Int. Cl.
*H04R 3/00* (2006.01)
*H04R 1/02* (2006.01)
*H04R 25/00* (2006.01)

(52) U.S. Cl. ..... 381/92; 381/91; 381/111; 381/312; 381/313; 381/314

(58) Field of Classification Search ..... 381/92, 381/122, 111, 312–315, 91; 340/515, 521
See application file for complete search history.

(56) References Cited

FOREIGN PATENT DOCUMENTS

JP 57075100 A * 5/1982
JP 07240990 A * 9/1995
WO WO2004/098232 11/2004

OTHER PUBLICATIONS

Applicant's admitted prior art, p. 1, lines 24-29.*
Patent Abstracts of Japan, vol. 1996, No. 1 (Jan. 31, 1996) of JP 07 240990 A, dated Sep. 12, 2005.
Patent Abstracts of Japan, vol. 1996, No. 1 (Jan. 31, 1996) of JP 07 240991, A, dated Sep. 12, 2005.
Patent Abstracts of Japan, vol. 6, No. 151 (Aug. 11, 1982) of JP 57 075100, dated May 11, 1982.

* cited by examiner

*Primary Examiner*—Devona E Faulk
(74) *Attorney, Agent, or Firm*—Dykema Gossett PLLC

(57) ABSTRACT

The invention concerns a method for detecting and minimizing the harmful influence of ultra sound in a listening device having two or more microphones. The energy contents in the microphone signals is determined, and time related changes in energy contents of the microphone signals is analysed to determine whether any of the microphones is subjected to an ultrasound sound-field, and the signal from the microphone with the lowest content of ultrasound is routed through a signal processing device to an output unit. The invention further concerns a listening device having means for choosing the microphone channel with the lowest level of ultrasound.

6 Claims, 1 Drawing Sheet

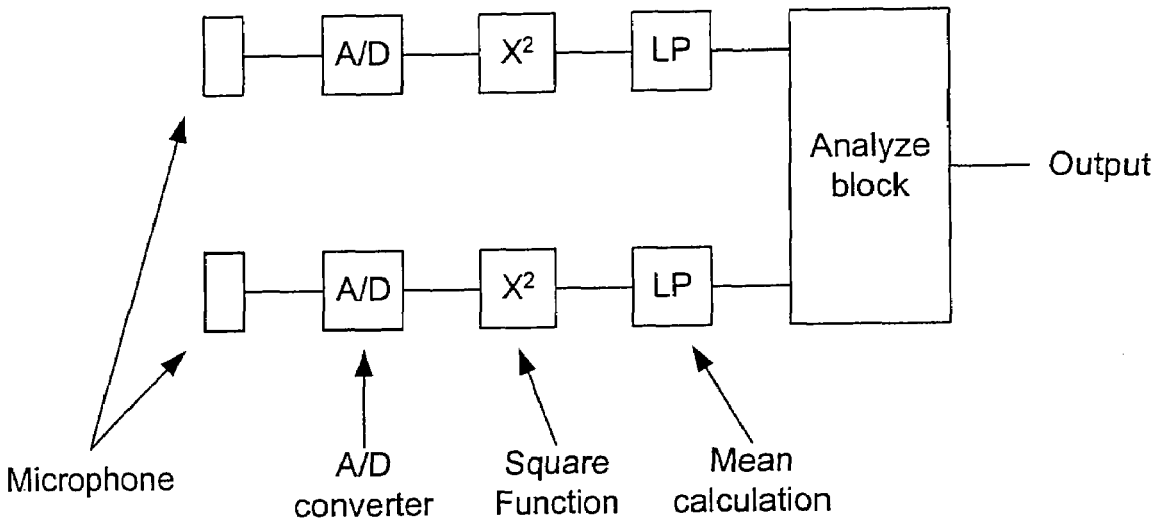
A/D
X2
LP
Analyze block
Output
A/D
X2
LP
Microphone
A/D converter
Square Function
Mean calculation

METHOD FOR DETECTION OF ULTRASOUND IN A LISTENING DEVICE WITH TWO OR MORE MICROPHONES, AND LISTENING DEVICE WITH TWO OR MORE MICROPHONES

AREA OF THE INVENTION

The invention concerns a method for detection of ultra sound in a listening device and a listening device with a plurality of microphones wherein means are provided for detection of the presence of ultrasound.

BACKGROUND OF THE INVENTION

When a hearing aid is subject to an ultrasound field in the environment, very annoying side effects may be experienced by the hearing aid user even if the ultrasound is at a frequency far above the audio range of the human ear. One side effect is possible saturation of microphones and the analogue to digital converter of the apparatus. The saturation is a result of the very powerful sound pressures which are not uncommon in connection with ultrasound devices like automatic door openers or alarm systems. Another side effect is caused by the nonlinearity whereby the sound waves will often convolve down and result in the generation of sound in the audio frequency range where people can hear it as noise. Also headsets or other listening devices having microphones may be adversely effected by the presence of ultrasound in the environment.

One way to reduce this effect is to use a ¼ wave resonator or other filter in the inlets before the microphones which reduces or removes the ultrasound before it reaches the microphone. This arrangement can be very costly because each microphone inlet must be modified to accommodate either the filter or the ¼ wave resonator, and further this complicates the production. Also filters may not in all instances be sufficient, in order to remove all harmful effects of the ultrasound sound field.

SUMMARY OF THE INVENTION

The invention concerns a method for detecting ultrasound and eliminating the harmful influence of ultra sound in a listening device having two or more microphones, whereby firstly the energy contents in the microphone signals is determined, and whereby time related changes in energy contents of the microphone signals is analysed to determine whether any of the microphones is subjected to an ultrasound sound-field, and whereby the signal from the microphone signal with the lowest content of ultrasound is routed through a signal processing device to an output unit.

When a listening device as a hearing aid with two or more microphones is placed in a ultrasound sound-field, the two microphone are often influenced quite differently by the ultra sound. Due to the very short wavelength of the ultrasound, one microphone port may be strongly influenced while the other port is hardly affected at all. This is used by the method in that the influence on the microphones of the ultrasound is monitored continuously and the signal from the microphone channel which is the least influenced by the ultra sound is routed to an output unit. The signal processing device is preferably a digital signal processing device and the output unit could be a receiver or other device externally or implanted into the ear or brain for providing a sensation of sound corresponding to the audio sounds in the environment.

In a further embodiment of the invention at least one microphone sound inlet is protected with an ultrasound protection device and at least one inlet is unprotected against ultrasound and further means are provided for detecting the presence of ultra sound. According to the invention, the detection means detects the presence of ultrasound, and if ultrasound is present, then the signal from the protected microphone is routed to the output device.

If ultrasound is present, the power in the two channels will be different since the protected channel will attenuate the signal and the unprotected will not. By measuring the power in the two channels it is possible to detect the ultrasound signal, since we know which channel is protected. The energy in the protected channel will be lower than the energy in the unprotected channel. We also know that the energy in the signal is very powerful since the signal results in saturation of the microphones and/or the A/D converters. If the ultrasounds energy is lower than the saturation limit the sound will not result in any problems for the device. If ultrasound is measured the system automatically shifts to the signal from the channel with the protection.

In situations with no ultrasound the power in the two channels will be almost equal because the ultrasound protection only influence the high frequency area with ultrasound.

The invention also comprises a listening device with two or more microphones whereby the listening device has means for detecting the presence of ultrasound in at least one microphone channel.

BRIEF DESCRIPTION OF THE DRAWINGS

FIG. 1 shows the device to detect the ultrasound according to the invention

DESCRIPTION OF A PREFERRED EMBODIMENT

The microphones and the A/D converters delivers the input to the system. The following signal processing calculates a mean value of the energy in each microphone channel. The energy of each channel is forwarded into the analyze block. This block decides if the signal picked up by the microphones is ultra sound or not.

The analyse block looks at the energy contents in the signal from the microphone channels, and when the energy in one or more channels rises very fast above a given limit and reaches a value close to or at the saturation limit, the signal from another microphone is routed to the hearing aid user. In this event any on-going directional- or other multi microphone algorithm must be terminated, and to this end a status value is routed from the analyse block to an overall control block of the listening device. Tests have shown that when a hearing aid or other listening device with microphones provided close to each other is moved about in an ultrasound sound field, at least one of the microphones will at most times be relatively un-affected by the ultra sound. This is quite unexpected, but as shown it is very useful, as it allows the user of the listening device to have at least one microphone functioning at most times also when the user is in a sound field of a ultrasound generator. Since the person is moving in the ultra sound field, and thereby changing the situation, the device must react fast. The purpose of the device is to use the microphone with the least amount of energy, when ultra sound is detected.

When a microphone with an ultrasound attenuation device is used the analyse block works in the following way:

1) detect if the energy in the unprotected microphone is above a given limit, 2) compare the energy from the two channels. If the energy in the unprotected channel is a given number of times X larger than the energy in the protected channel, then the output should be "ultrasound detected", and a corresponding status value routed to the digital signal processing unit.

Ad. 1) The limit value depends on the limit of saturation in a microphone. For a hearing aid microphone this limit is around 115-120 dB spl.

Ad. 2) The given number of times X depends on the efficiency of the ultrasound attenuation device provided at the at least one microphone.

When a microphone without an ultrasound attenuation device is used the analyse block works in the following way:

1) detect if the energy in one of the microphones is above a given limit, 2) compare the energy from the two channels. If the energy in the channel with the highest energy is a given number of times X larger than the energy in the other channel, the output should be "ultrasound detected", and a corresponding status value is routed to the digital signal processing unit.

Ad. 1) The limit value depends on the limit of saturation in a microphone. For hearing a aid microphone is this limit around 115-120 dB spl.

Ad. 2) The given number of times X depends on the efficiency of the ultrasound attenuation device provided at the at least one microphone.

The above example regards a device having two microphones, but the inventive concept is easily extended to devices having three or more microphones.

The invention claimed is:

1. A method for detecting and minimizing harmful influence of ultra sound in a hearing aid having two or more microphones, comprising the steps of determining the energy contents in the microphone signals, analyzing time-related changes in energy contents of the microphone signals to determine when the energy in one or more channels rises to a given number of times larger than the energy in an other channel, and thus whether any of the microphones is subjected to an ultrasound sound-field, and sending a corresponding status value to the digital signal processing unit so that the signal from a microphone signal with the lowest content of energy is routed through a signal processing device to an output unit.

2. The method as claimed in claim 1, comprising providing at least one signal from a microphone without an ultrasound attenuation device and providing at least one signal from a microphone with an ultrasound attenuation device and whereby the signal energy content in the signals from the different microphones are analyzed to determine whether the device is in an ultrasound sound-field, and if ultrasound is present, the signals from the microphone or microphones with the ultrasound attenuation devices is/are routed through the signal processing device to the output unit.

3. A hearing aid with two or more microphones, each providing an electrical signal, a signal processing device and a receiver for delivering a signal to the user in order to provide a sensation of sound, wherein the signal processing device comprises means for detecting the presence of ultrasound in at least one microphone channel comprising means for calculating the energy content in the signal from each microphone and means for comparing the energy from the channels in order to detect the situation whereby the electrical signal from at least one of the microphones reaches an energy content close to or at the saturation point and at least one microphone is relatively unaffected, and wherein the signal processing comprises means for routing the signal from a microphone channel with the least amount of energy content to the receiver when the above situation is detected.

4. The hearing aid as claimed in claim 3, wherein the microphones comprise inlet channels, wherein at least one of the microphone inlet channels comprises mechanical means for attenuating ultrasound received from the environment, wherein at least one microphone inlet channel is unprotected from the ultrasound energy, and wherein the means for routing the signal from a microphone channel when ultrasound is detected can rout the signal from the microphone channel containing the mechanical attenuation means to the receiver.

5. The hearing aid as claimed in claim 4, wherein the mechanical means comprises a ¼ band resonator.

6. The hearing aid as claimed in claim 4, wherein the mechanical means comprises ultrasound attenuating filter material.

* * * * *